United States Patent [19]

Grigorenko et al.

[11] 4,208,895

[45] Jun. 24, 1980

[54] METHOD AND APPARATUS FOR CONTROLLING A HYDRAULIC SCREW PRESS

[76] Inventors: Anatoly S. Grigorenko, ulitsa Tovstukho, 1, kv. 21; Jury A. Moroz, ulitsa Fugenfirova, 3, kv. 91, both of Omsk; Jury A. Bocharov, 15 Parkovaya ulitsa, 18, korpus 1, kv. 109; Anatoly V. Safonov, Sevastopolsky prospekt, 51, korpus 1, kv. 11, both of Moscow; Vladimir V. Landyshev, ulitsa 50 let VLKSM, 14a, kv. 22, Omsk; Gennady A. Vasiliev, ulitsa Olimpiiskaya, 6, kv. 8, Omsk; Lidia A. Sakharova, ulitsa P. Osminina, 6, kv. 7, Omsk; Nikolai A. Stolyarov, ulitsa 27-yalinia, 16a, kv. 67, Omsk, all of U.S.S.R.

[21] Appl. No.: 927,877

[22] Filed: Jul. 25, 1978

[51] Int. Cl.[2] ..... B21J 9/20

[52] U.S. Cl. ..... 72/8; 72/19; 72/21; 72/453.03; 72/454; 100/289

[58] Field of Search ..... 72/454, 8, 19, 28, 21, 72/441, 453.01, 453.18, 453.03; 100/289, 270, 271

[56] References Cited

U.S. PATENT DOCUMENTS

| | | | |
|---|---|---|---|
| 1,913,663 | 6/1933 | Ferris | 100/270 |
| 3,512,476 | 5/1970 | Georg | 100/270 |
| 3,589,278 | 6/1971 | Brauer | 72/454 |

FOREIGN PATENT DOCUMENTS

| | | | |
|---|---|---|---|
| 907353 | 10/1962 | United Kingdom | 100/289 |

*Primary Examiner*—Daniel C. Crane
*Assistant Examiner*—Gene P. Crosby
*Attorney, Agent, or Firm*—Steinberg & Blake

[57] ABSTRACT

The ram of the press is accelerated to an acceleration-terminating point whereat it attains a speed providing for the required energy of impact upon the work. During the acceleration, the velocity of the ram is measured, as well as the deviation of the actual point of attaining the required speed relative to the preset acceleration-terminating point. Depending on the value of this deviation, either the extent of the acceleration path is varied, with the acceleration value maintained constant, or else the acceleration rate is varied, with the acceleration path length remaining permanent. To effect control by varying the acceleration path length, the control system is provided with specific electric circuitry controlling a transmitter generating a signal sent to a solenoid-operated valve, to vary the latter's position so as to vary accordingly the approach portion of the ram's stroke, and thus to vary the acceleration path. To effect control by varying the acceleration rate, the control system likewise is provided with specific electric circuitry controlling the value of the pressure of the liquid supplied from a hydraulic accumulator into the hydraulic drive of the press.

12 Claims, 6 Drawing Figures

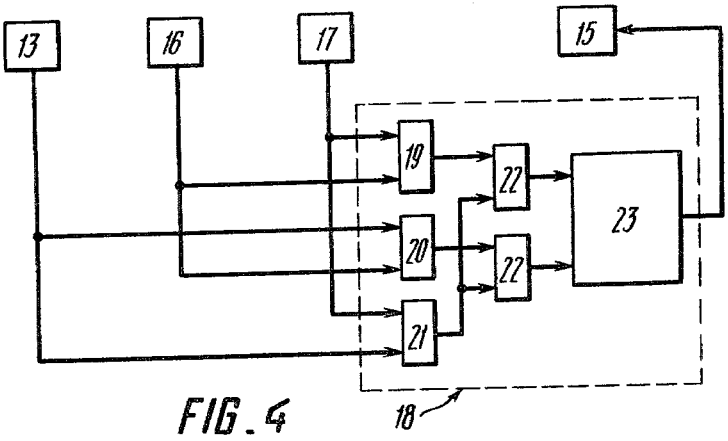
FIG. 4
FIG. 5
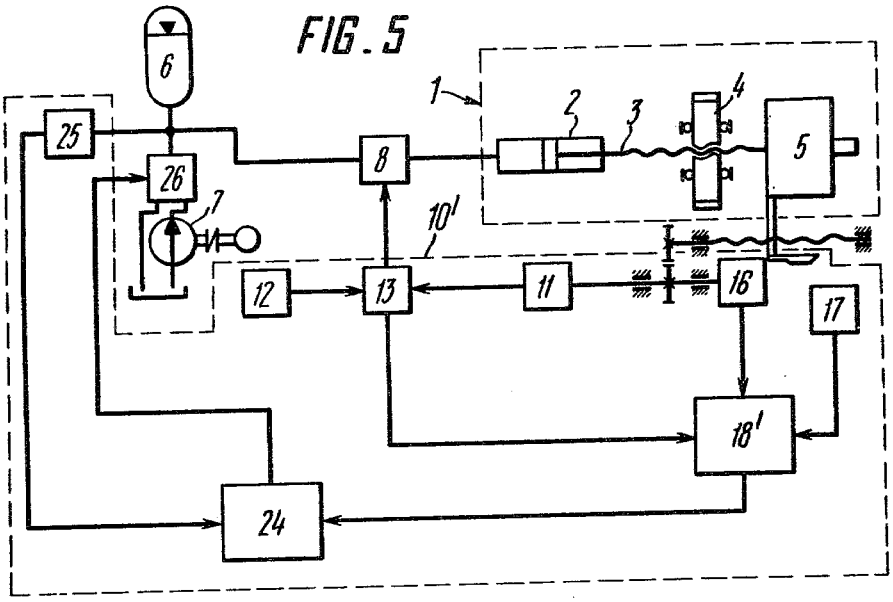

METHOD AND APPARATUS FOR CONTROLLING A HYDRAULIC SCREW PRESS

BACKGROUND OF THE INVENTION

The present invention relates to working by forging and pressing, and, more particularly, it relates to a method of controlling hydraulic screw presses and apparatus capable of performing such a method.

Over the recent years, presses of the hydraulic-screw type have been finding an ever wider field of applications, owing to their offering an advantage over other previously known pressing machinery, residing in their inherent capacity of having the impact energy regulated within a relatively wide range, i.e. of metering-out the impact energy.

This advantage provides for more accurate dimensions of the shaped work, and also reduces the wear of the tooling and prolongs the life of the pressing machines.

While effecting the operation of a hydraulic screw press, in most cases the ram is driven, first, through the approach path or portion of its stroke, whereafter the ram is accelerated to a required speed, with the acceleration terminated upon the ram having attained the required speed corresponding to the required impact energy.

One of the disadvantages of this known control method is inadequate accuracy of metering-out the impact energy, which is explained by the fact that upon the working fluid distributing device having been turned off following the acceleration, the speed of the ram decreases. This takes place on account of the cutting-off of the supply of the working fluid being effected upon the ram attaining the required speed at a certain distance from the point of the engagement between the tool and the work.

The ram has to pass this distance by the momentum gained (i.e. by the kinetic energy stored by the movable portions of the press), while the working fluid is not supplied into the hydraulic drive cylinder of which the movable element follows the motion of the ram. This results in the suction being created, and the liquid stream breaking somewhere in the line communicating the distributing device with the cylinder, whereby the ram is noticeably braked over this portion of its path.

Consequently, the speed or velocity of the ram at the moment of delivering an impact upon the work would differ from the preset one, this actual final speed of the ram being dependent predominantly on the length of its path after the termination of the supply of the working fluid.

However, as experiments have proved, the point in the path whereat the ram attains a required speed is not a permanent one, but is prone to shift in accordance with various factors such as variation of the viscosity of the working fluid, varying press lubrication conditions, pressure fluctuations in the pressure accumulator, and so on. This results in a varying distance between the point of deenergization of the drive and the point of impact, whereby the final speed of the ram varies.

Hence, the attained impact energy differs from the preset one, and the accuracy of metering-out the energy is inadequate.

The above described method is performed by apparatus including a speed sensor or transmitter connected via mechanical gearing to the ram of the press, and a speed comparison unit having its inputs connected to the master speed control and the speed sensor. The output of the speed comparison unit is connected to the solenoid controlling the distributing device in the hydraulic line connecting the accumulator with the hydraulic drive cylinder of the press.

However, this apparatus is not proof against the shortcomings of the abovedescribed method.

SUMMARY OF THE INVENTION

It is an object of the present invention to provide a method of controlling a hydraulic screw press, which should provide for attaining a higher accuracy of metering-out the impact energy.

It is another object of the present invention to provide an apparatus providing for metering-out the impact energy of a press with a high accuracy.

It is yet another object of the present invention to enhance the accuracy of the dimensions and the quality of the shaped work.

It is still another object of the present invention to reduce the wear of the tooling and to prolong the service life of a press.

These and other objects are attained in a method of controlling a hydraulic screw press, including accelerating the movable portions of the press to attain the required impact energy to shape a work, measuring the speed of the motion of the movable portions, and, upon having attained by such acceleration the speed corresponding to the preset impact energy, terminating the acceleration. In the method of the present invention, a point of terminating the acceleration is preset, and, by following the speed value, the deviation of the point of attaining the preset speed from the preset acceleration-terminating point is determined. Value of the deviation is used to vary at least one of the parameters of the motion of the movable portions, to attain the required speed at the impact point.

It is expedient in the control process to maintain the acceleration rate constant over the acceleration path and to vary the length of this acceleration path.

In this embodiment, the movable portions are first driven at a permanent speed through the approach portion or path, and then accelerated at a constant acceleration rate to the required speed. In accordance with the invention, depending on the deviation of the point of attaining the preset speed from the preset acceleration-terminating point, the length of the approach path is varied, with the length of the acceleration path varying accordingly.

Alternatively, also in accordance with the invention, the acceleration-terminating point is preset, and, by following the speed value, the deviation of attaining the preset speed from the preset acceleration-terminating point is determined. This obtained value of the deviation is used to vary the acceleration rate of the movable portions over the acceleration path, with the length of the acceleration path being constant.

In this case, in order to vary the acceleration rate, the pressure of the working fluid of the hydraulic screw press, acting on the movable portions being accelerated, is varied.

An apparatus for controlling a hydraulic screw press with the acceleration effected over a variable-length path, as hereinabove described, includes a hydraulic accumulator and a working liquid supply pump, connectable through a solenoid-controlled valve with the hydraulic cylinder of the hydraulic drive of the ram of the press. A sensor is responsive to the ram passing the termination point of the approach path, and is connected to an actuator for displacing said sensor. The actuator is connected to the controlled valve connecting the accumulator and the hydraulic cylinder. A sensor is responsive to the ram speed. A master control of the ram speed is provided. The ram speed sensor and master control are connected to a speed comparison circuit adapted to send a signal to the valve to cut off the connection between the accumulator and the hydraulic cylinder. In accordance with the invention, a system controls the actuator of the sensor responsive to the ram passing the termination point of the approach path. The system includes a sensor responsive to the ram passing the preset acceleration-terminating point, a sensor which senses displacement of the ram and a logic control circuit connected to the outputs of said sensors and to the output of the speed comparison circuit. The logic control circuit inhibits the sending of a signal from the ram displacement sensor when signals are sent simultaneously from the speed comparison circuit and from the acceleration-terminating point sensor. The logic control circuit passes the signal of the ram displacement sensor when only one of the above two signals is sent.

It is expedient that the logic control circuit should include means responsive to the direction of the actuation of the approach path termination point sensor.

It is further expedient that the logic control circuit should include three logical AND elements or gates of which the first AND element has its respective inputs connected to the ram displacement sensor and the sensor responsive to the ram passing the preset acceleration-terminating point. The second AND element has its respective inputs connected to the ram displacement sensor and the speed comparison circuit. The third AND element has its respective inputs connected to the speed comparison circuit and the sensor responsive to the ram passing the preset acceleration-terminating point. The logic control circuit also includes two inhibition gates of which the inhibiting inputs are connected to the output of the third AND element. The pass-no pass inputs of the inhibition gates are connected to the outputs of the first and second AND elements. The outputs of the inhibition gates are connected to a ring-type commutator controlling the stepping motor of the actuator which controls the displacement of the approach path termination sensor.

An apparatus for controlling a hydraulic screw press wherein acceleration is effected at a variable acceleration rate, as described hereinabove, includes a hydraulic pressure accumulator connectable through solenoid-controlled valves with the hydraulic cylinder of the hydraulic drive of the ram of the press, a ram speed sensor and a ram speed master control. The ram speed sensor and master control are connected to a speed comparison circuit adapted to send a signal to a solenoid-controlled valve to cut off the communication between the accumulator and the hydraulic cylinder. In accordance with the present invention, a system controls the pressure in the hydraulic line connecting the accumulator and the hydraulic cylinder. The system comprises a sensor of the ram passing the preset acceleration-terminating point, a ram speed sensor and a logic control circuit connected to the outputs of said sensors and the speed comparison circuit. The logic control circuit produces a signal proportional to the required variation of the pressure to attain the preset impact energy. The signal is supplied to an input of the pressure control circuit and another input of said circuit is connected to a pressure transducer or sensor. The output of the pressure control circuit is connected to a solenoid-controlled valve adapted to connect the hydraulic accumulator alternatively to the pump and to a drain line, respectively, to raise and lower the pressure in the hydraulic line.

It is expedient that in this embodiment the logic control circuit should include means responsive to the sense of the variation of the pressure in the hydraulic line. The logic control circuit includes three AND logic elements or gates, with the first AND element having its respective inputs connected to the speed displacement sensor and the sensor of the ram passing the preset acceleration-terminating point. The inputs of second AND element are connected to the ram displacement sensor and the speed comparison circuit. The inputs of the third AND element are connected to the speed comparison circuit and the sensor of the ram passing the preset acceleration-terminating point. The logic control circuit also includes two inhibition gates of which the respective inhibiting inputs are connected to the output of the third AND element and the other inputs are connected, respectively, to the outputs of the first and second AND elements. The outputs of the inhibition circuits are connected to a reversible counter of which the output is connected to the first input of a digital-to-analog converter. The other input of the digital to analog converter is connected to the output of the third AND element and the output of said converter is connected to the pressure control circuit.

BRIEF DESCRIPTION OF THE DRAWINGS

For a fuller understanding of the invention, reference is had to the following description taken in connection with the accompanying drawings, in which:

FIG. 4 is a block diagram of an embodiment of the logic circuit of the apparatus of FIG. 3;

FIG. 5 is a block diagram of another embodiment of the apparatus of the invention for controlling a hydraulic screw press with the pressure value being variable.

DESCRIPTION OF PREFERRED EMBODIMENTS

Figure 1:
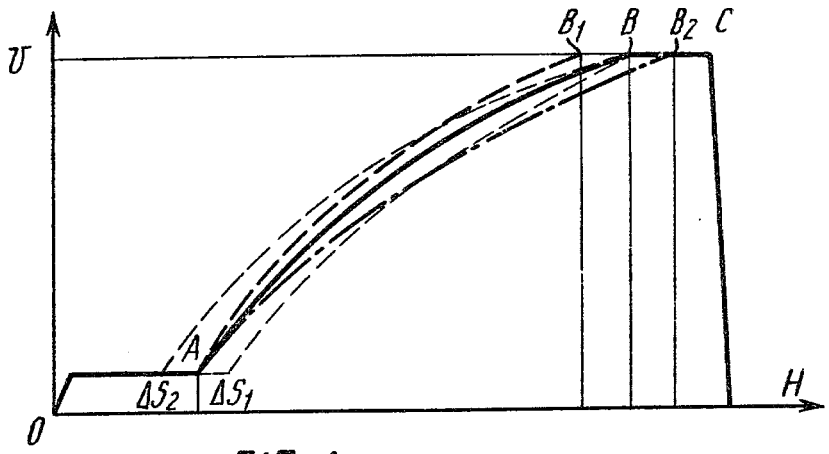
FIG. 1 shows a chart illustrating the method of controlling a hydraulic screw press by varying the acceleration path length.

Reference is now made to the method of the invention by referring to the chart in FIG. 1 wherein the variation of the ram speed of a hydraulic press in the course of the working stroke thereof is plotted.

The ram stroke is commenced at point "O" and is effected at a constant speed to point "A". This portion of the stroke is called the approach path and is effected by supplying the working fluid into the cylinder of the press directly from the pump, as further explained hereinafter in connection with the apparatus embodying the method. At point "A" the supply of the working fluid from the pressure accumulator is turned on, whereby a constant driving effort is provided by the pressure of the fluid onto the movable member of the hydraulic cylinder. Consequently, the ram of the press is driven at a constant acceleration rate, which means that the ram speed increases from point "A" to point "B". This portion of the stroke is hereinafter called the acceleration path.

Upon the ram attaining the preset speed at point "B", the supply of the working fluid from the pressure accumulator into the hydraulic cylinder is discontinued, and the remaining portion "BC" of the stroke to point "C" of engagement with the work, where the shaping of the work is started, is travelled by the ram due to gained momentum.

The point "B" is preselected at a specific small distance "BC" from point "C", so that the ram travelling over the distance should not be influenced noticeably by the braking action due to the discontinuation of the working fluid supply to the hydraulic cylinder.

If it is assumed, however, that the preset speed v is attained at point "$B_1$", spaced from point "C" by a distance "$B_1C$" in excess of "BC", this means that the ram has gained or stored the required amount of energy before reaching point "B". Then the distance "$B_1B$" can be considered the value of deviation of the point of attaining the preset speed. Then, depending on this value, the length of the acceleration path is reduced by shifting the acceleration starting point "A" toward the point "B" in the working-stroke direction, i.e. the length of the approach path is increased by $\Delta S_1$ equalling "$B_1B$".

If it is assumed, on the other hand, that the preset speed is attained at point "$B_2$" closer to point "C", this means that the required energy is attained after the ram has reached the point "B". The distance "$B_2B$" is the deviation by which the length of the acceleration path is, according to the method proposed, increased by shifting point "A" in the direction against the working stroke of the ram (i.e. toward point "O"). The approach path is thus reduced by the deviation value $\Delta S_2$.

Thus, the aim of attaining the preset speed at a predetermined point is realized by varying or adjusting the acceleration path length.

The same aim can be attained, however, by varying another parameter of the motion, i.e. the value or rate of acceleration. This case will be discussed with reference to the chart in FIG. 2.

The stroke of the ram is initiated at point "C" by turning on the supply of the liquid from the accumulator, whereby acceleration occurs, and the speed of the ram starts rising from the very beginning. Upon the ram attaining the required speed at point "D", a speed sensor produces a signal to cut off the supply of the working fluid into the hydraulic cylinder, and the acceleration is terminated, whereafter the ram strikes the work at point "E". The distance "ED" is selected on the described principle.

If the preset speed is attained at point "$D_1$", which means that the required energy has been stored before the ram reaches point "D", the acceleration rate of the movable parts is varied accordingly, i.e. reduced by reducing the pressure in the accumulator by a value ensuring that no deviation "$D_1D$" occurs during the next successive stroke.

Similarly,, the pressure is increased if the preset speed is attained at point "$D_2$".

The aforedescribed modifications of the method of the invention may obviously be employed in various combinations.

A basic premise of the invention is to preset a point at a specific distance from the impact point, which distance should positively not practically affect the speed by reducing same, and to positively set this point by measuring the speed and varying the parameters of the ram motion.

The apparatus of the invention is capable of effecting the control by varying the approach path length, as been described with reference to FIG. 1. The hydraulic screw press 1, illustrated generally in FIG. 3, comprises a hydraulic cylinder 2, a screw 3, a flywheel 4 and a ram 5. The hydraulic screw press 1 is shown purely schematically because its exact structure is well known to any person competent in the art and has no direct bearing on the essence of the present invention.

The apparatus for controlling this hydraulic screw press includes a hydraulic pressure accumulator 6 and a pump 7 communicating with the hydraulic cylinder 2 via a solenoid-controlled valve 8. Furthermore the pump communicates with the hydraulic accumulator via a check valve 9 in order to provide pressure adjustment.

The control apparatus further includes an electric control system 10 which provides the control functions for varying the acceleration path length whenever necessary. The system 10 includes a speed sensor 11, e.g. a tachogenerator connected via mechanical gearing with the ram 5, and a master speed control 12, e.g. one including a voltage divider. The speed sensor 11 and the master speed control 12 are connected to a speed comparison circuit 13, e.g. of the null-detector type, well known in the art of automatic control. The system 10 also includes a sensor or transmitter 14 of the ram passing the approach path termination, e.g. in the form of any suitable limit switch, either of a contact or non-contact type, associated with an actuator or drive 15 for setting it to a desired position.

The approach path termination sensor 14 is connected to the solenoid-controlled valve 8, so that when said sensor sends a signal, said valve is turned on to connect the hydraulic accumulator 6 with the hydraulic cylinder 2.

The system also includes a ram displacement sensor 16 responsive to the value of the displacement of, or the distance travelled by, the ram 5, in the form of any suitable known linear displacement transducer, e.g. a ring-type pulsed transducer connected via mechanical gearing to said ram. An acceleration terminating point sensor 17 of the ram passing the preset acceleration terminating point, may comprise any suitable track switch of any known type. The outputs of the sensors 16 and 17 are connected to a logic control circuit 18 which controls the actuator 15 of the approach path termination transmitter 14. The logic circuit 18 passes the signal from the ram displacement sensor 16 to the actuator 15 when signals from the speed comparison circuit 13 and from the acceleration-terminating point sensor 17, respectively, are provided at different moments. The actuator 15 may comprise a reversible motor. If the signals from the aforedescribed two elements are provided simultaneously, the logic control circuit 18 inhibits the transmission of a signal from the sensor 16 to the motor 15.

One possible embodiment of the logic control circuit 18 is illustrated in FIG. 4. The logic control circuit includes three logic and elements or gates 19, 20 and 21. The respective inputs of the first AND element 19 are connected to the ram displacement sensor 16 of the and to the acceleration terminating point sensor 17. The inputs of the second AND element 20 are connected to the ram displacement sensor 16 and the speed comparison circuit 13. The inputs of the third AND elements 21 are connected to the speed comparison circuit 13 and to the acceleration terminating point sensor 17. The logic control circuit also includes first and second inhibition gates 22*a* and 22*b*, respectively. The inhibiting inputs of the inhibition gates 22*a* and 22*b* are connected to the output of the third AND element 21. The pass-no pass inputs connected, respectively, to the outputs of the inhibition gates 22*a* and 22*b* are of the first and second AND elements 19 and 20. The outputs of the inhibition circuits 22*a* and 22*b* are connected to a ring-type switch or commutator 23 adapted to switch over the windings of the actuator 15 consisting of a stepping reversible motor which drives the approach path termination sensor 14 (FIG. 3) to a desired position.

The aforedescribed embodiment of the apparatus of the invention operates, as follows. Pressurized working fluid is supplied by the pump 7 through the solenoid-controlled valve 8 to the hydraulic cylinder 2. In this manner, the approach path of the ram 5 is commenced. Upon the ram 5 actuating or driving the approach path termination sensor 14, said sensor produces a signal for the solenoid-operated valve to switch over to supply the pressurized working fluid into the hydraulic cylinder 2 from the hydraulic pressure accumulator 6. The acceleration path of the ram 5 is commenced. While the ram 5 is accelerating, a growing output signal is sent by the ram speed sensor 11 to the input of the speed comparison circuit 13, while the ram displacement sensor 16 sends a pulsed signal, proportional to the displacement or path travelled by the ram 5, to the logic controlled circuit 18. When the ram 5 attains the preset speed, an output signal is sent by the speed comparison circuit 13 to the solenoid-controlled valve 8, to cut off the supply of the working fluid from the hydraulic accumulator 6 to the hydraulic cylinder 2. The acceleration of the movable portions of the press is terminated, and the further progress of the ram 5 to the point of the impact against the work is effected by the momentum gained, i.e. by the kinetic energy stored.

The following situations are possible.

(1) The ram 5 attains the preset speed at the point where the acceleration terminating point sensor 17 indicates that the ram passes the preset acceleration terminating point).

In this case the respective output signals of the speed comparison circuit 13 and the acceleration terminating point sensor 17 are simultaneously supplied to the respective inputs of the third AND element 21, whereby said third AND element passes an output signal to the inhibiting inputs of the inhibition circuits 22*a* and 22*b*. The pulses from the ram displacement sensor 16 are not transmitted to the inputs of the ring-type commutator 23 controlling the rotation of the stepping motor 15. Consequently, there is no correction of the position of the approach path termination sensor 14, since no such correction is actually required. (2) The ram attains the preset speed before the operation of the acceleration terminating point sensor 17.

If this is the case, the signal of the speed comparison circuit 13 supplied to the respective input of the second AND element 20 does not interfere with the transmission of pulses from the transmitter 16 to the pass-no pass input of the inhibition circuit 22*b*. No signal is sent to the inhibiting input of the inhibition circuit 22 from the third AND element 21, because said third AND element receives only one signal from the speed comparison circuit 13. Consequently, pulses from the ram displacement sensor 16 are fed to the "plus" input of the ring commutator 23 which distributes these pulses among the windings of the stepping motor 15. The stepping motor 15 often rotates and shifts the approach path termination sensor 14 in the direction of matching the moment of attaining the preset speed with the preset point. As the ram moves further on, acceleration terminating point sensor 17 operates, and the other signal is fed to the input of the third AND element 21, so that said third AND element passes an output signal to the inhibiting inputs of the inhibition gates 22*a* and 22*b*. The supply of pulses to the ring-type commutator 23 is terminated, and the stepping motor 15 stops. The position of the approach path termination sensor 14 is such that at the next successive cycle of operation of the press, the ram would attain the preset speed at the preset acceleration-terminating point.

(3) The ram attains the preset speed after the operation of the acceleration terminating point sensor 17.

The signal of the acceleration terminating point sensor 17 is fed to the first AND element 19, and pulses from the ram displacement sensor 16 are passed to the input of the first inhibition gate 22*a*. Since at this moment there is no signal coming from the speed comparison circuit 13 to the input of the third AND element 21, no signal is supplied to the inhibiting inputs of the inhibition gates 22*a* and 22*b*, whereby pulses from the output of the first AND element 19 are transmitted to the ring-type commutator 23 to rotate the motor 15 and to displace the approach path termination sensor 14 in the direction opposite to the one of the previously described situation. Meanwhile, the ram 5 moves on with its speed increasing, and when it attains the preset value, the speed comparison circuit 13 provides an output signal to the respective input of the third AND element 21. The third AND element 21 passes a signal to the inhibiting inputs of the inhibition gates 22*a* and 22*b*, whereby the motor 15 is stopped at the moment when the approach path termination sensor 14 has been set to a position whereat the ram would attain the preset speed at the preset point upon its next-successive stroke.

Figure 2:
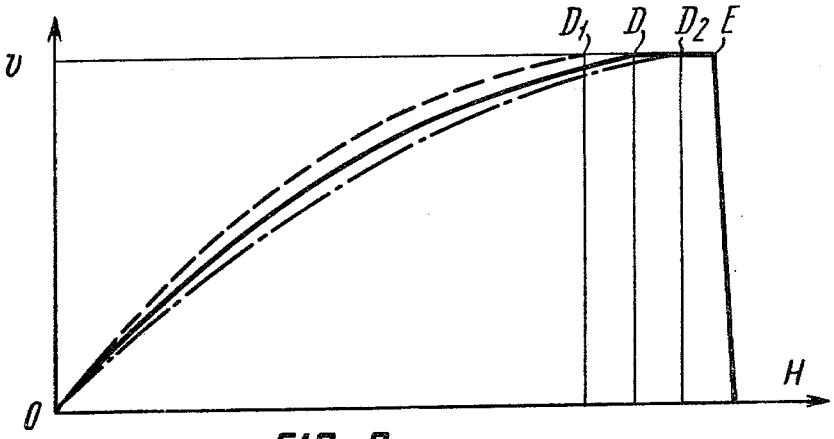
FIG. 2 shows a chart illustrating the method of controlling a hydraulic screw press by varying the acceleration rate of the movable portions thereof.

Another embodiment of the apparatus of the invention capable of performing the disclosed method of control effects the control action by varying the supply pressure, as hereinbefore described with reference to FIG. 2.

Figure 3:
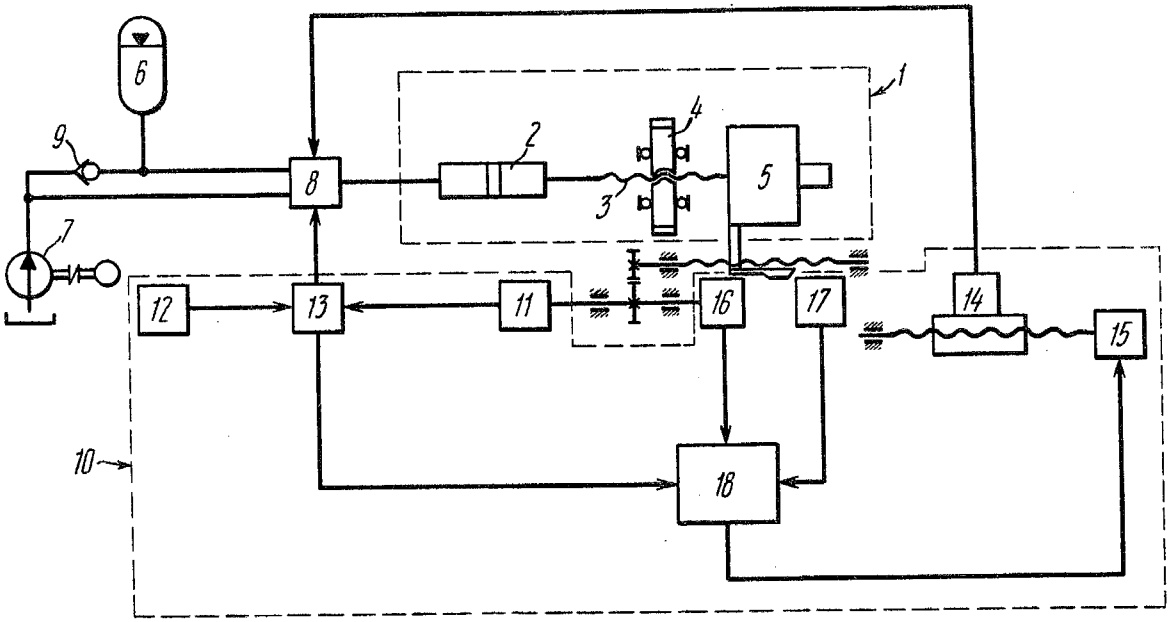
FIG. 3 is a block diagram of an embodiment of the apparatus of the invention for controlling a hydraulic screw press with the acceleration path length being variable, and includes the hydraulic screw press per se.

The block diagram of the apparatus shown in FIG. 5 contains predominantly the same or similar elements as the apparatus illustrated in FIG. 3. The difference between the apparatus of FIGS. 3 and 5 is in that an electric pressure control circuit 10' incorporates means for varying the pressure in the hydraulic supply line between the accumulator and the hydraulic cylinder, including a pressure control circuit 24. The inputs of the pressure control circuit 24 are connected to the output of the logic control circuit 18' and the pressure variation transducer 25. The output of the pressure control circuit 24 is connected to a regulator including a solenoid-controlled valve 26 adapted to establish communication between the pump 7 and the hydraulic accumulator 6, should it be necessary to raise the pressure in the line through which the working fluid is supplied to the hydraulic drive, or between the hydraulic accumulator 6 and a drain line, when said pressure is to be reduced. The circuit of FIG. 5 has no approach path termination sensor 14 (FIG. 3) with its associated actuator.

The logic control circuit 18' of the embodiment of FIG. 5 also differs from the logic control circuit 18 of FIG. 3.

Figure 6:
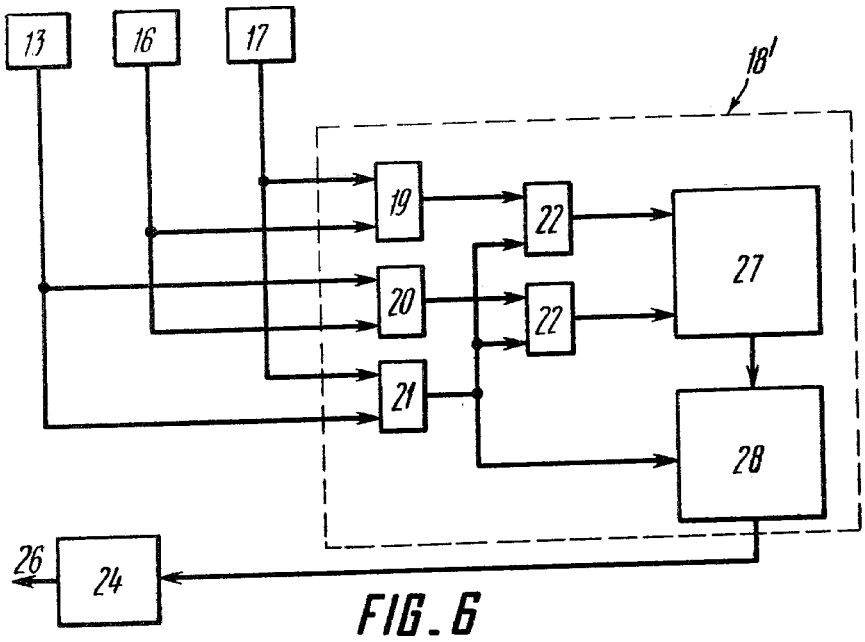
FIG. 6 is a block diagram of a logic circuit of apparatus of FIG. 5.

The block diagram of the circuit 18' is illustrated in FIG. 6. The circuit includes the same logic elements 19, 20, 21, 22 which have been described, and a reversible pulse counter 27. The inputs of the pulse counter 27 are connected to the outputs of the first and second inhibition circuits 22*a* and 22*b* . The output of the pulse counter 27 is connected to the first input of a digital to analog converter 28 of the code-to-voltage type. The second input of the digital to analog converter 28 is connected to the third AND element 21 and the output of said converter is connected to the pressure control circuit 24.

The apparatus of FIG. 5 operates as follows. With the press energized for operation, the solenoid-controlled valve 8 is turned on to connect the hydraulic cylinder 2 to the hydraulic accumulator 6, whereby acceleration of the ram 5 is commenced. As the ram 5 accelerates, the ram speed sensor 11 sends an increasing signal to the respective input of the speed comparison circuit 13, while the ram displacement sensor 16 feeds to the logic control circuit 18' a pulse signal proportional to the value of the displacement or path travelled by the ram.

Upon the ram 5 attaining the preset speed, the output signal of the speed comparison circuit 13 is fed to the valve 8 and said valve cuts off the supply of the pressurized working fluid from the hydraulic accumulator 6 to the hydraulic cylinder 2. The acceleration of the movable portions of the press is terminated, and the further movement of the ram to the point of delivering an impact upon the work is effected by the momentum gained, i.e. by the kinetic energy stored.

The following situations may occur.

(1) The preset speed is attained by the ram at the moment of operation of the acceleration terminating point sensor 17 responding to the ram passing the acceleration terminating point.

In this case signals from the transmitter 16 fed to the respective inputs of the first and second AND elements 19 and 20 (FIG. 6) are not transmitted to the inputs of the reversible counter 27, because with signals coming simultaneously to the inputs of the third AND element 21 from the speed comparison circuit 13 and from the acceleration terminating point sensor 17, the AND element 21 passes an output signal to the inhibition circuits 22*a* and 22*b* to inhibit the transmission of the pulses.

Hence, the system 10' develops no correction signals.

(2) The ram attains the preset speed before the acceleration terminating point sensor 17 sends an output signal.

If this is the case, the output signal of the speed comparison circuit 13 fed to the respective other input of the second AND element 20 permits the transmission of pulses from the ram displacement sensor 16 to the respective input of the second inhibition circuit 22*b*, while no signal is fed to the inhibiting input of said second inhibition circuit 22 from the AND element 21, because only the signal from the speed comparison circuit 13 is fed to the respective input of said third AND element. Consequently, pulses from the ram sensor displacement 16 are fed to the direct-count input of the reversible counter 27, which counts the pulses. As the ram moves on, the acceleration terminating point sensor 17 responds, and the second input signal is sent to the third AND element 21, whereby said third AND element passes an output signal to the inhibiting inputs of the inhibition gates 22*a* and 22*b*.

The supply of pulses to the reversible counter 27 is discontinued, with the counter having registered a number corresponding to the motion of the ram from the point of attaining the preset speed to the point of operation of the acceleration terminating point sensor 17. Such number is being converted in the digital-to-analog converter 28 into a voltage value proportional to the required pressure variation and is fed to the input of the pressure control circuit 24 when said converter receives the output signal from the third AND element 21. The moment this voltage value of the corresponding polarity is fed to the input of the pressure control circuit 24, said circuit provides at its output a signal for turning on the control valve 26 so that the hydraulic accumulator is connected to drain, whereby the pressure therein drops until the signal from the pressure transducer 25 equals the signal from the DA converter 28. The moment the equality is achieved, the valve 26 is turned off, with the pressure having been reduced to a value ensuring that in the next successive cycle of the press operation the ram would attain the preset speed precisely at the preset acceleration terminating point.

(3) The ram attains the preset speed after the operation of the acceleration terminating point sensor 17.

The signal from the acceleration terminating point sensor 17 is fed to the first AND element 19, whereby pulses are fed from the transmitter 16 to the input of the first inhibition circuit 22*a*. At this moment no signal is sent to the input of the third AND element 21 by the speed comparison circuit 13, and the pulses thus travel from the output of the first AND element 19 to the count-down input of the counter 27. The counter 27 counts the pulses down. As the ram moves on, its speed continues to increase, and when it attains the preset value, the speed comparison circuit 13 produces an output signal which is fed to the respective input of the third AND element 21, whereby the inhibiting inputs of the inhibition gates 22*a* and 22*b* receive a signal, and the counting of the pulses is interrupted. At the same time, the output of the third AND element 21 is fed to the input of the DA converter 28, opening up the transmission of the voltage signal to the pressure control circuit 24. The output signal of the pressure control circuit turns on the control valve 26, so that the pump 7 is connected to the accumulator 6. The pressure in the accumulator rises. The moment the signal from the pressure transducer 25 equals the output of the DA converter 28, the pressure control circuit 24 turns the valve 26 off, and the pressure build-up is terminated, with the pressure having been built up to a value ensuring that in the next successive operating cycle the ram would attain the preset speed at the preset point.

We claim:

1. A method of controlling a hydraulic screw press, including accelerating the movable portions of the press over an acceleration path to a preset acceleration terminating point whereat said movable portions have attained a speed sufficient for providing the required energy of impact upon a workpiece; while thus accelerating, measuring the speed of said movable parts and determining the value of deviation of the point of attaining the preset speed from the preset acceleration terminating point, and using the value thus obtained to vary at least one of the parameters defining the motion of said movable portions, so that the predetermined speed should be attained at the point of delivering an impact upon the workpiece.

2. A method as claimed in claim 1, including maintaining a constant acceleration rate over the acceleration path and varying the length of the acceleration path.

3. A method as claimed in claim 2, including moving the movable portions, first, at a constant speed over an approach path and then accelerating them at a constant acceleration rate to a preset speed and varying the length of the approach path to vary the length of the acceleration path correspondingly in dependence upon the deviation of the point of attaining the preset speed from the preset acceleration terminating point.

4. A method as claimed in claim 1, including maintaining the acceleration path length constant and varying the rate of acceleration of the movable portions over the acceleration path.

5. A method as claimed in claim 4, including varying the pressure of the working fluid acting upon the movable portions of the hydraulic screw press for their acceleration, to vary the acceleration rate.

6. Apparatus for controlling a hydraulic screw press including a ram moving along an approach path to a workpiece and a hydraulic drive cylinder coupled to the ram by varying the length of the approach path, the approach path having a preset acceleration terminating point and a point of termination, said apparatus comprising a reservoir of hydraulic fluid for the ram;

a hydraulic pressure accumulator;

a pump for supplying hydraulic fluid from the reservoir;

duct means for transferring hydraulic fluid from said pump to the hydraulic drive cylinder of the ram and from said accumulator to said drive cylinder;

a solenoid-controlled valve in said duct means for selectively connecting said drive cylinder to said accumulator and said pump;

an approach path termination sensor for determining the passing of the point of termination of the approach path by the ram, said approach path termination sensor being electrically connected to the solenoid-controlled valve and producing a signal for opening said valve to connect said accumulator to said drive cylinder via said duct means under predetermined circumstances;

an actuator coupled to said approach path termination sensor for selectively adjusting the position of said approach path termination sensor relative to said point of termination of the approach path;

a ram speed sensor for determining the velocity of said ram;

master speed control means for presetting a velocity for enabling said ram to store an impact energy sufficient to shape said workpiece;

a speed comparison circuit having an input electrically connected to said ram speed sensor, another input electrically connected to said master speed control means, an output electrically connected to said solenoid-controlled valve and another output, said speed comparison circuit producing an output signal for closing said valve to cut off said accumulator from said drive cylinder under predetermined conditions; and an actuator control system for controlling said actuator, said actuator control system including an acceleration terminating point sensor for determining the passing of the acceleration terminating point of the approach path by said ram and producing an output signal upon said passing, a ram displacement sensor for determining the displacement of said ram and producing an output signal in accordance with said displacement, and a logic control circuit having inputs electrically connected to said acceleration terminating point sensor, said ram displacement sensor and the other output of said speed comparison circuit and an output electrically connected to said actuator, said logic control circuit inhibiting the transfer of the output signal of said ram displacement sensor when output signals are simultaneously produced by said speed comparison circuit and said acceleration terminating point sensor and permitting the transfer of the output signal of said ram displacement sensor when only one of said speed comparison circuit and said acceleration terminating point sensor produces an output signal to control said actuator to correspondingly displace said approach path termination sensor.

7. Apparatus as claimed in claim 6, wherein said logic control circuit of said actuator control system includes means responsive to the direction of the displacement of said approach path termination sensor by said actuator.

8. Apparatus as claimed in claim 6, wherein said logic control circuit of said actuator control system includes first, second and third logical AND elements each having a first input, a second input and an output, the inputs of said first AND element being electrically connected to said ram displacement sensor and said acceleration terminating point sensor, respectively, the inputs of said second AND element being electrically connected to said ram displacement sensor and said speed comparison circuit, respectively, the inputs of said third AND element being electrically connected to said speed comparison circuit and said acceleration terminating point sensor, respectively, a first inhibition gate having an inhibiting input electrically connected to the output of said third AND element, a pass-no pass input electrically connected to the output of said first AND element and an output, a second inhibition gate having an inhibiting input electrically connected to the output of said third AND element, a pass-no pass input electrically connected to the output of said second AND element and an output, and a ring-type commutator having an input electrically connected to the output of said first inhibition gate, another input electrically connected to the output of said second inhibition gate and an output electrically connected to said actuator, said commutator transferring signals from said inhibition gates to said actuator to control the displacement of said approach path termination sensor.

9. Apparatus as claimed in claim 8, wherein said actuator comprises a stepping motor electrically connected to the output of said commutator and coupled to said approach path termination sensor.

10. Apparatus for controlling a hydraulic screw press including a ram moving along an approach path to a workpiece and a hydraulic drive cylinder coupled to the ram by varying the pressure of hydraulic fluid, the approach path having a preset acceleration terminating point, said apparatus comprising a reservoir of hydraulic fluid for the ram;

a hydraulic pressure accumulator;

a pump for supplying hydraulic fluid from the reservoir;

duct means for transferring hydraulic fluid from said pump to the hydraulic drive cylinder of the ram and from said accumulator to said drive cylinder, said duct means including a drain line;

a first solenoid-controlled valve in said duct means for selectively connecting said drive cylinder to said accumulator and said pump;

a ram speed sensor for determining the velocity of said ram;

master speed control means for presetting a velocity for enabling said ram to store an impact energy sufficient to shape said workpiece;

a speed comparison circuit having an input electrically connected to said ram speed sensor, another input electrically connected to said master speed control means, an output electrically connected to said solenoid-controlled valve and another output, said speed comparison circuit producing an output signal for controlling said valve to control the connection of said accumulator and said drive cylinder;

a second solenoid-controlled valve in said duct means for selectively connecting said accumulator to said pump and said drain line; and a pressure control system for controlling the pressure of hydraulic fluid operating said ram, said pressure control system including an acceleration terminating point sensor for determining the passing of the acceleration terminating point of the approach path by said ram and producing an output signal upon said passing, a ram displacement sensor for determining the displacement of said ram and producing an output signal in accordance with said displacement, and a logic control circuit having inputs electrically connected to said acceleration terminating point sensor, said ram displacement sensor and the other output of said speed comparison circuit and an output, said logic control circuit producing a control signal at its output proportional to a pressure variation required to attain the preset velocity of said master speed control means, a pressure variation transducer in said duct means for converting the pressure of the hydraulic fluid supplied to said drive cylinder to an electrical signal, and a pressure control circuit having an input electrically connected to said transducer for receiving an output electrical signal from said transducer, another input electrically connected to the output of said logic control circuit for receiving an output control signal from said logic control circuit and an output connected to said second solenoid-controlled valve for providing a control signal and for connecting said accumulator to said pump to increase the pressure of hyraulic fluid supplied to said drive cylinder and for connecting said accumulator to said drain line to decrease the pressure of hydraulic fluid supplied to said drive cylinder.

11. Apparatus as claimed in claim 10, wherein said logic control circuit of said pressure control system includes means responsive to the sense of variation of the pressure of the hydraulic fluid.

12. Apparatus as claimed in claim 10, wherein said logic control circuit of said actuator control system includes first, second and third logic AND elements each having a first input, a second input and an output, the inputs of said first AND element being electrically connected to said ram displacement sensor and said acceleration terminating point sensor, respectively, the inputs of said second AND element being electrically connected to said ram displacement sensor and said speed comparison circuit, respectively, the inputs of said third AND element being electrically connected to said speed comparison circuit and said acceleration terminating point sensor, respectively, a first inhibition gate having an inhibiting input electrically connected to the output of said third AND element, a pass-no pass input electrically connected to the output of said first AND element and an output, a second inhibition gate having an inhibiting input electrically connected to the output of said third AND element, a pass-no pass input electrically connected to the output of said second AND element and an output, a reversible couter having an input electrically connected to the output of said first inhibition gate, another input electrically connected to the output of said second inhibition gate and an output, and a digital to analog converter having an input electrically connected to the output of said reversible counter, another input electrically connected to the output of said third AND element and an output electrically connected to said other input of said pressure control circuit.

* * * * *